United States Patent [19]

Salvans et al.

[11] 4,248,592

[45] Feb. 3, 1981

[54] METHOD AND APPARATUS FOR COLORING TOW AND COLORED TOW PRODUCED THEREFROM

[76] Inventors: Juan Salvans, Circuito Medicos No. 87, Estado De Mexico Ciudad Satelite, Mexico; Carlos Del Cueto, Andes No. 645, Mexico 10, D.F., Mexico; Fernando L. Del Cueto, Sierra Madre No. 125, Mexico 10, D.F., Mexico

[21] Appl. No.: 11,940

[22] Filed: Feb. 13, 1979

Related U.S. Application Data

[63] Continuation of Ser. No. 778,932, Mar. 18, 1977, abandoned.

[51] Int. Cl.[3] ..... D06P 7/00

[52] U.S. Cl. ..... 8/485; 8/487

[58] Field of Search ..... 8/14, 62

[56] References Cited

U.S. PATENT DOCUMENTS

| | | | |
|---|---|---|---|
| 530,831 | 12/1894 | Florin-Leclerco | 68/203 |
| 3,530,693 | 9/1970 | Dimond et al. | 8/14 |
| 3,541,958 | 11/1970 | Keown | 8/14 |
| 3,958,925 | 5/1976 | Fleissner | 8/14 |

*Primary Examiner*—John Kight, III

*Attorney, Agent, or Firm*—Toren, McGeady and Stanger

[57] ABSTRACT

A method is disclosed for applying color to continuous synthetic fibers in the form of tow comprising the steps of first spreading the tow into a flattened sheet, applying color in a first predetermined design pattern to one side of the sheet so as to impregnate the color into the depth of the sheet to a given depth, and then applying color in a second predetermined design pattern to the other side of the sheet so as to impregnate the color into the depth of the sheet from the other side. The thus treated tow is suitable for forming into blended yarn, commonly known as "heather". An apparatus is also disclosed for accomplishing the above treatment and continuous fibers in the form of tow having intermittent portions of said fibers colored are also disclosed.

8 Claims, 4 Drawing Figures

METHOD AND APPARATUS FOR COLORING TOW AND COLORED TOW PRODUCED THEREFROM

This is a continuation of application Ser. No. 778,932, filed Mar. 18, 1977, now abandoned.

BACKGROUND OF THE INVENTION

1. Field of the Invention

This invention relates to the field of the coloring of continuous synthetic filaments in the form of tow for conversion into yarn having the color known as "heather".

2. Description of the Prior Art

As used herein, the term "heather" which is a well known term of art, will refer to a product in the form of a yarn ultimately formed from staple and which has a color which is formed from the blending of white and colored pieces of staple or staple having white and colored portions thereon. Such heather yarns are conventionally used in the formation of fabrics for wearing apparel and the like, although, of course, many type of end uses are possible. While the term "heather" generally refers to the color, it has also become conventional to designate the product as heather.

There are currently two commercial methods for the production of heather. In the first method, a continuous synthetic fiber, such as, acrylic or polyester, although other synthetics may be used, which fiber is in the form of tow, is cut into staple and preformed into sliver. It is understood that the terms "staple" and "sliver" are well known and in particular, "sliver" refers to a rope formed from staple which has been blended sufficiently to give the rope some cohesiveness so that it may be further treated.

The sliver thus formed is then wound onto a bobbin which generally weighs from about 8 to 10 kg, although more or less weight can be used per bobbin depending on the particular type process which is going to be used as well as the type of synthetic fiber and its own weight. In any event, such bobbins are conventionally referred to as "tops".

A number of such tops are then placed onto a creel which may accommodate 16 or more of the tops. The sliver from each of the tops are then simultaneously (all the ends) fed through a gill box to form an extremely thin sheet which is referred to as a "lap". The lap is sufficiently thin so as to substantially expose most of the fibers to the subsequent processing.

This lap is then printed on one side by passing the lap between a print roll having a plurality of raised portions, generally in the form of a spiral thereon, and a second roll which is coated with an absorbent material and which is impregnated with dye. As a result, that side of the lap which contacts the impregnated roll is printed with a design pattern corresponding to that of the print roll. Moreover, because the print roll is in pressurized contact with the absorbent covering of the impregnated roll, the design pattern essentially impregnates through the thickness of the lap.

The design generally printed onto the lap results in the individual filaments of the sliver which, as noted, are formed from blended pieces of staple, having colored and uncolored portions. That is to say, the uncolored portions are the color of the original fiber which is essentially white.

The thus printed lap is then gathered, typically through a funnel type gathering device, and collected into essentially a single rope and treated using the usual dye fixation procedures, washing treatments, drying treatments, etc., such treatments being conventional and depending on both the type of dye and type of synthetic fiber that is being used.

After the fixation and subsequent processing treatments, the rope must then be reformed into sliver. The sliver is then formed into tops again for shipment to the processing center for the conventional blending treatments to prepare the yarn.

One of the significant disadvantages of the above process which is commonly referred to as the "Vigereux" process, is the fact that it can only be used to treat sliver, i.e., material which has been precut into staple. Thus, the process is completely unsuitable and cannot be used with tow, which is a rope formed from the fibers which are in continuous filament form The basic reason for this is that tow cannot be treated by passing through a gill box because it is formed from continuous filament rather than from staple. Consequently, tow cannot be formed into a thin lap as can sliver. Also, tow as it comes from the manufacturer, has a crimp in it which results from the manufacturing process. Thus it has been thought that because of the inability to form tow into a lap, one cannot achieve the substantial impregnation of all of the fibers as is required in the Vigereux process to produce a suitable product for forming into heather.

The second method for forming heather is by cutting two, formed from continuous filaments, into staple, converting the staple into sliver, and then forming the sliver into tops. The tops are then subjected to a "package or unit type" dyeing operation wherein the individual tops are placed into sealable containers and are dyed in much the same way as in the conventional "package dyeing" procedure. This results, of course in the tops being 100 percent dyed with the particular color being used.

The thus dyed tops are fixed, washed, dried, etc., using conventional procedures and these dyed tops are then creeled with an appropriate number of undyed white tops, depending on the ultimate color blend which is desired in the heather. The ends of all of these creeled tops are then subjected to blending through a series of gills, blenders, etc., for preparation into a yarn.

The disadvantages of this process are apparent since the ultimate blending is obtained by taking sliver of one color and/or sliver of another color and uncolored sliver and blending these individual pieces. The pieces of sliver are relatively large and consequently, the homogeneity of the resulting heather is not particularly good due to the large splotches of color which will occur.

Turning again to the Vigereux process, a number of other disadvantages attend the utilization of this process. For example, it is relatively slow because of the necessity of using the gill box. The gill box essentially separates the fibers of the sliver in such a way that a suitably thin lap can be formed. This is, however, an extremely slow process and consequently, the speed of the subsequent printing step is controlled by the speed of the gill box treatment.

Another problem is the fact that, in the Vigereux process, extensive breaks in the form of "wrap-arounds" on the print wheel occur. This is primarily due to the fact that the lap is extremely thin and is composed of cut fibers. Thus, many fiber ends pass through the print roll and covered roll and the chances for the ends catching on to the roll and wrapping around the roll are very high.

Moreover, since, in the Vigereux type process, one is feeding a series of 16 or more different ends of sliver into the machine, and this sliver is composed of cut fibers, from time to time, due to a slight catch in the tops, the sliver will pull apart or break. This, like the "wrap-arounds" necessitates shutting down of the machine in order to tie the slivers or remove the wrap-arounds.

In practice, two workers are required to monitor the Vigereux process at all times. One of the workers monitors the print roll to continually remove any small wrap-arounds which are formed so as to avoid their expanding into large wrap-around. The other worker is required to continuously monitor the creel so as to repair any breaks in the sliver.

With respect to the second process described hereinabove, one of the major disadvantages is that it is essentially a bulk type dyeing process. That is to say, the tops are placed within a chamber and dye stuff in a relatively large volume of solvent is forced through the tops under pressure. In dyeing processes of this type, the efficiency of the dye usage is relatively poor. After the dyeing operation, not all of the dye is exhausted from the dyeing liquid. However, this dyeing liquid is no longer usable and is generally discarded. Consequently, the process is quite expensive considering the amount of dye wasted in the process, the large amount of energy required and the large amount of solvent or water wasted.

Another problem of this process is the fact that it creates pollution problems. Thus, the used dyestuff solution must be discarded and, assuming that the solvent is water, it will generally be disposed of in conventional sewage. However treatment may be required to properly prepare it for entry into the sewage system.

In the event that an organic solvent system is used, the solvent cannot be dumped but rather, must be recovered. Also, of course, such organic solvents create air pollution problems and cannot be vented to the atmosphere. Also, organic solvents, are relatively expensive and, consequently, processes are usually required in the overall treatment to recover as much of the solvent as possible. This, of course, adds to the overall expense of the process.

Finally, because dyestuffs diluted in large volumes of solvent, are utilized in this type process, relatively large volumes are constantly being treated and this is another disadvantage of the process, since larger equipment is needed.

Also, in this unit dyeing type of process, when it is desired to change colors, the down-time is quite extensive since all of the equipment must be completely cleaned and all contamination of the old dyestuff must be removed from the dye tanks. This is a fairly intricate process and requires a significant amount of time in practice.

One important aspect of the so-called "package-dyeing" system is that when a mixture of dyestuffs is to be used to achieve a given color, the dyes must be compatible with respect to their exhaust rates from the dye bath. That is to say, their exhaust rate curves must be similar. If they are not compatible and do not have the same or similar exhaustion rates, uneven dyeing will occur.

Consequently, the choice of dyestuffs for use in such combinations is quite limited with this process and often result in the necessity of utilizing relatively expensive dyes in order to obtain the appropriate compatibility.

A major problem attendant both to the Vigereux type process as well as the unit or package dyeing type process described above is the fact that they both treat sliver which is formed from staple and cannot be utilized to treat tow. This has a significant effect on acrylic fiber when it is desired to have a "high bulk yarn". In producing such a high bulk, the bulk is usually imparted to the acrylic fiber at the time of cutting it into staple. Thus, the bulk is imparted to the undyed fiber.

However, in both the Vigereux and the unit dyeing process, the staple is ultimately dyed and thus must necessarily be subjected to dye fixation treatments. Such treatments usually involve heating of the sliver. As a result of this second heating the original high bulk which was imparted to the fiber is destroyed. Consequently, a heather product having high bulk cannot be produced by either the Vigereux or the unit dyeing process because of the necessity of the subsequent dye fixation treatments which destroy the high bulk previously imparted to the fiber.

It is also possible, with acrylic fibers, to produce heather utilizing the so-called "tunnel dyeing" technique. This enables acrylic fiber to be dyed in the form of tow. However, the fiber passed through the "tunnel dyeing" process, which is a conventional process, is completely dyed with the particular color.

However, the tunnel dyeing technique has a number of disadvantages, one of which is the fact that because of the speed of the process and the narrowness of the dyeing chamber where the dye is aged and steamed after being applied to the fiber, the dyes often do not set exactly properly. Thus, for example, if one is using a dye composition composed of several colors, the tow exiting the chamber will often be observed to have spots of the individual colors thereon rather than a blend of the colors. This is due to the fact that the exact steaming or other finishing treatment conditions were not sufficient for each of the individual colors. While it is possible to subsequently blend the thus dyed material in such a manner as to obliviate the inhomogeneity resulting from the dyeing, when another batch of tow is treated in an attempt to obtain the same color, it cannot be done since it is virtually impossible to duplicate the non-homogeneity that occurred in the previous batch.

Also, of course, with respect to the tunnel dyeing technique, in order to form the heater product, an ultimate blending of individual slivers must be effected as with the unit dyeing treatment.

SUMMARY OF THE INVENTION

Applicants have discovered a method for producing heather which can be utilized directly on continuous filament in tow form without having to first cut the tow into staple and form sliver therefrom and then treat the sliver. As a result, the present process avoids all of the disadvantages of the prior known processes utilized for producing heather and further is faster, more economical, and produces a more homogeneous heather product than the prior art processes.

Particularly, the present process is a method for applying a color to continuous synthetic fibers in the form of tow wherein the tow is first spread into a flattened sheet, color is applied to the flattened sheet in a first predetermined design pattern to one side of the sheet so as to impregnate the color into the depth of the sheet and then color is applied in a second predetermined design pattern to the other side of the sheet so as to impregnate the color into the depth of the sheet from the other side.

This process is carried out on an apparatus which is composed of means for spreading the tow into a flattened sheet, first means for applying color to one side of the sheet in the first predetermined design pattern and to impregnate the color into the depth of the sheet and second means for applying color to the other side of the sheet in a second predetermined design pattern and so as to impregnate the color into the depth of the sheet, the second means being positioned subsequent to the first means.

The tow which is produced by the present process is quite unique in that it is formed from continuous filaments which have intermittent colored and uncolored portions along their lengths.

More particularly, the method of the present invention involves utilizing dye application stations which are composed of a print roll having raised portions thereon, a second roll disposed opposite the print roll and in pressurized contact therewith, which second roll has an absorbent outer covering thereon for retaining coloring agent or a dye and means for impregnating the absorbent covering. By passing the sheet of tow through or between these two rolls, an appropriate pattern corresponding to that of the predetermined design pattern is imprinted and impregnated into the depth of the sheet on the side of the sheet contacting the impregnated covering. The thus printed tow is then sent to a second dye station wherein the positioning of the rolls is opposite to that of the first dye station so that the pattern is produced on the other side of the sheet and is also impregnated into the depth of the sheet.

Thereafter, the thus printed or colored tow, the continuous fibers of which have intermittent colored and uncolored portions along their lenghts, is subjected to the conventional dye fixation, scouring, washing, drying, etc. techniques after which it may be cut into staple and processed in the usual manner to produce heater.

By virtue of the fact that the present process treats tow as opposed to sliver, a number of significant and highly unexpected advantages result. Thus, for example, as compared to the Vigereux process, the present process is much faster, and in fact, can be run twice as fast or perhaps even more than twice as fast as the Vigereux process. The reason for this is that tow is substantially stronger since it is composed of continuous filaments as opposed to cut up filaments as is sliver. Moreover, because a gill box is not utilized to form the flattened sheet, the process can also be run faster since the gill box, as noted hereinbefore, is a relatively slow treatment for forming the sliver into an extremely thin sheet. Also, the extensive breaks in the form of "wrap-arounds" and breaks in the sliver which are attendant the Vigereux process do not occur in the present process since the tow is in continuous filament form. This further results in the fact that only one operator is required to monitor the present process as opposed to the two operators required for the Vigereux type process.

With respect to the bulk type dyeing process discussed hereinabove, the present process is advantageous in that because the fibers have splotches or intermittent color along their length as opposed to being completely dyed one color and having to be subsequently blended with sliver of another color, a more more homogeneous heather product is ultimately obtained. The reason for this is that one is dealing with much smaller units of colored and uncolored fiber. Additionally, all of the dye is effectively utilized in the present process since there is no concern with exhaustion of the dyestuff as there is no immersion of the material into the dyestuff contained in a liquid. This results in a significant saving in dyestuff. Moreover, it avoids the pollution problems which are attendant the use of large volumes of water or organic solvents generally encountered with the bulk type dyeing process. Also, of course, the extensive down time for change of colors which is required with the bulk type dyeing process is not encountered with the present process since it is much easier to merely clean the rolls, change absorbent coverings and proceed with treatment with the new color.

Finally, a very significant improvement and advantage of the present process as opposed to both the Vigereux and bulk type dyeing processes is the fact that one can obtain a heather product having high bulk. Thus, the present process treats the acrylic fiber in the form of continuous filament, and dyes it and subjects the filaments to the dye fixation treatments prior to its being cut into staple. Consequently, there are no subsequent heat treatments after the high bulk treatment as in the prior art processes and the resulting heather product will retain the high bulk given to it during the staple cutting process.

Moreover, considering the bulk dyeing process, since the present process does not utilize the exhaustion technique of the dyes, one can use two or more inexpensive dyes since they need not be compatible with respect to their exhaustion rate curves.

As opposed to the "tunnel dyeing" technique which is utilized for tow, the dye inhomogeneities which occur with this process do not occur with the present process and consequently it is much easier to produce uniformity from one run of tow to another.

DESCRIPTION OF THE PREFERRED EMBODIMENT

Figure 1:
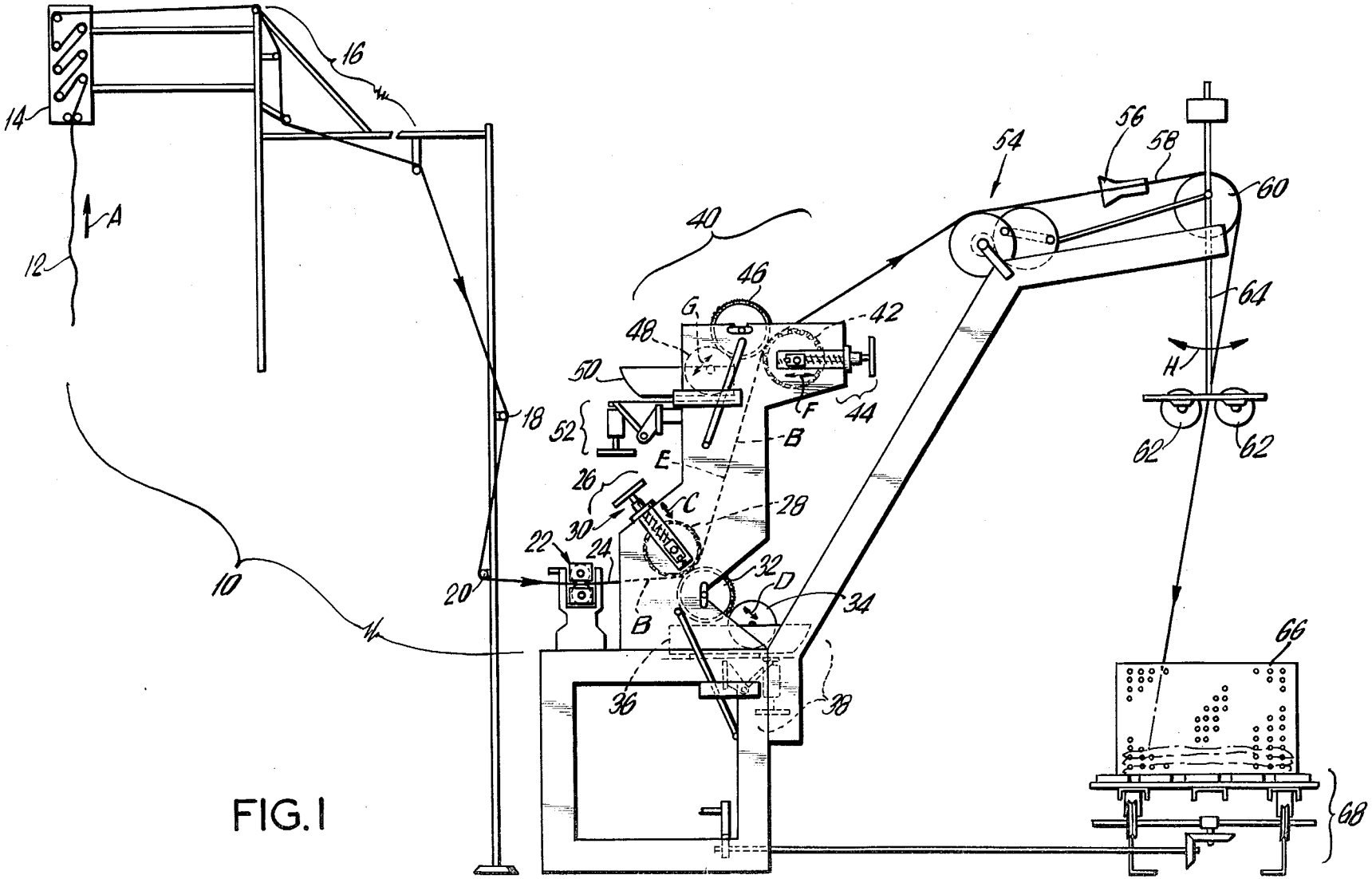
FIG. 1 is a schematic diagram of the process flow scheme of the present invention and the apparatus of the present invention.

Referring to FIG. 1, the process of the present invention is carried out according to the scheme shown and the apparatus depicted therein. Particularly, means for spreading tow is depicted generally at 10 which comprises a conventional sequence of rollers such that the tow generally in the form of a somewhat crimped rope as it is received from the producer at 12 is fed in the direction shown by arrow A into a plurality of rollers designated generally as 14 and through overhead rollers 16, 18 and turning roller 20, into press rollers 22 whereby the tow at 24 is formed into a relatively flat sheet. As the tow proceeds from rollers 14 to and through rollers 22, it is gradually spread apart to form the relatively flat sheet. Rollers 22 may be any type of opposing rollers, although generally, rollers having longitudinal ribs along their longitudinal axis are used. These are the usual type of feeding rollers used in textile processing machinery.

The tow 24, after it has passed rolls 22, is in the form of a sheet which is approximately 1/32 to ½ inch thick. It should be understood, that the tow cannot be formed into a completely flat or extremely thin sheet, as can sliver fed from a creel of tops. This is because it is composed of continuous filaments and, as manufactured, has a multiplicity of crimps along the length of the fibers which are produced due to the nature of the method of manufacture of tow. Thus, sheet 24 is actually a relatively thick sheet with a relatively rough surface due to the variation in thickness as well as the crimps which are present in the tow.

Thereafter, the two in sheet form 24 proceeds through a first coloring or printing station 26 wherein the side of the tow sheet indicated as B is imprinted with a predetermined design pattern.

Coloring station 26 is composed of a print roller 28 which has a plurality of raised portions thereon in the form of a preselected or predetermined design pattern. Typically, this roll is made of metal and preferably of stainless steel, since the latter is easily cleaned for color changes. Preferably, the raised portions of the roll are in the form of spirals running circumferentially about the periphery of the roll and longitudinally along the longitudinal axis of the roll. Most preferably, there are four such raised portions as can be evidenced from viewing the roll in cross-section as is shown in FIG. 1, although an increased number of such spirals may also be used depending on the particular type of dye or color coverage of the tow sheet 24 which is desired. Also, of course, the pitch of the spirals may be varied, again, depending on the end pattern and coverage desired.

As shown, print roll 28 is an undriven roll and is mount on a spring loaded roll positioning device such that roll 28 can be moved in either direction along the double arrow indicated as C by adjusting handle 30.

Pad roll 32 is a driven roll and has a covering of an absorbent material thereon. The covering may be any type of absorbent material which will absorb a dye, however, preferably an all wool covering is utilized.

Roll 32 is in a fixed position, i.e., it is not movable along the direction shown by double arrow C and is only slightly spaced apart or in actual contact with print roll 28 so that sheet 24 can pass between the two rolls. It is thus clear that adjustment device 26 can be adjusted so as to vary the amount of pressure or contact between print roll 28 and pad roll 32. Also, by virtue of the pressurized contact of print roll 28, sheet 24, and covered roll 32, rotation of roll 32 is used to convey the sheet past the dye station. Of course, other conventional means of conveying sheet 24 through the process can be used.

Opposing roll 32, on the opposite side from print roll 28, is dye transfer roll 34 which typically has a resilient coating thereon, e.g., rubber. A portion of dye transfer roll 34 is immersed in dye reservoir 36 and rotates therein for the purpose of picking up dye and transferring the picked up dye to pad roll 32.

Dye transfer roll 34 is undriven, however, it is attached to spring loaded adjustment means 38 which are similar to means for the purpose of moving dye transfer roll in either direction along the double arrow designated as D. As a result, the degree of pressure of dye transfer roll 34 against pad roll 32 can be varied by appropriate adjustment utilizing adjustment means 38.

Consequently, because of the absorbent coating or covering about pad roll 32, and utilizing means 38, dye transfer roll 34 can be adjusted so as to press against the absorbent covering of roll 32 to a greater or lesser degree. The covering of roll 32 after a few turns is completely saturated or impregnated with the dye transfer red thereto by roll 34, and by varying the pressure exerted by dye transfer roll 34, one can obtain a squeegee type effect which serves the purpose of controlling the amount of dyestuff impregnated in the covering. Thus, by applying more pressure with dye transfer roll 34, more of the dye will be squeezed from pad roll 32 and will drip back into reservoir 36 and this will have an overall effect of decreasing the amount of dye ultimately transferred to side B of sheet 24. Conversely, by decreasing the pressure of dye transfer roll 34 on pad roll 32 roll 32 will retain more dye and consequently more dye will be transferred to side B of sheet 24.

It is also thus seen that the adjustment means 26 attached to print roll 28 serves a different purpose from adjustment means 38 attached to dye transfer roll 34. Thus, adjustment means 26 serves only to maintain pressurized contact between roll 28, sheet 24 and roll 32. As roll 32 is driven in the appropriate direction, it in turn serves to move sheet 24 between rolls 32 and 28. Moreover, the raised portions or ribs on roll 28 as it is turning will press into sheet 24 and, in turn press the corresponding portions of the sheet contacted by the raised portions into the absorbent covering of roll 32. This server to transfer or print the dyestuff impregnated into the covering of roll 32 onto and into side B of sheet 24 in those areas corresponding to the raised portions of roll 28.

It is understood, of course, that other means would be easily ascertainable by the skilled artisan with respect to either adjusting the relative pressures of the rolls against one another or for impregnating the covering of roll 32 with the dye mix.

It is further noted that inasmuch as this is essentially a printing type of operation as opposed to a vat dyeing type of mechanism, the dyestuff in reservoir 36 is in the form of a relatively thick paste, i.e., has a relatively small amount of solvent or liquid.

It is as a result of this that the dye utilization in the present process is highly efficient since there is essentially no dye thrown away due to any type of dye exhaustion or depletion of the bath. As dye is continually transferred to the sheet, the amount of dye in reservoir 36 decreases and it is merely required to add additional dye paste thereto to maintain an appropriate level of paste therein. It is further easy for the operator to calculate, based on the knowledge of the total length of tow to be treated, decreases process speed, coverage, etc., the rate of paste utilization. It is merely required to add additional dye paste from time to time thereto to maintain an appropriate level of paste therein. It is easy for the operator, based on the above factors, to accurately estimate exactly how much dye paste will be required for the total run so that very little residual dye paste will remain in the reservoir at the end of the given run.

After traversing the first dye station, the sheet of tow printed on side B proceeds to a second dye station designated generally as 40.

Figure 3:
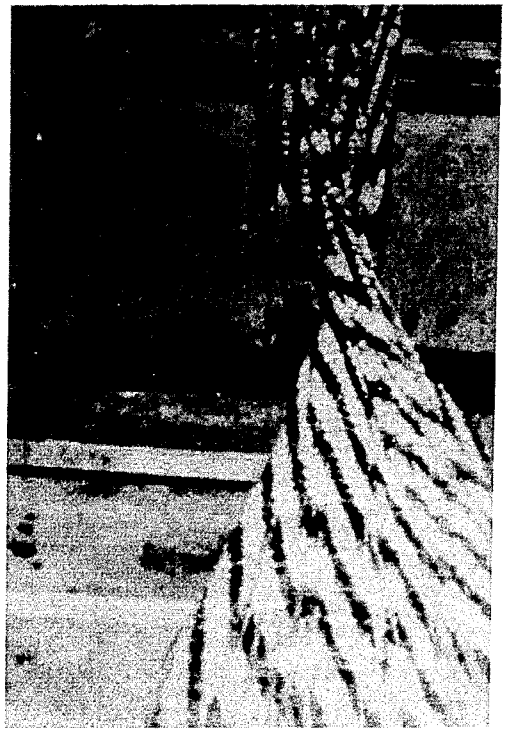
FIG. 3 is a photograph of one side of a sheet of tow colored by the process of the present invention.

Referring now to FIG. 3, a photograph of side B of the tow sheet as it emerges from the first dye station is shown. It can be seen that the dye, which in this case was dark brown, has been printed in essentially a diagonal pattern traversing the width of the sheet.

It is further noted that at the first print station, it is not just those fibers which may happen to be on the surface of side B of the sheet which are exposed to the dye. Because of the pressure between rolls 28 and 32 and the absorbent and resilient character of the covering of roll 32, the dye actually impregnated into the thickness of the sheet and generally will impregnate a substantial portion if not all of the sheet thickness. The pressures of the relative rolls are adjusted in order to assure such depth of penetration as is required. This impregnation is important since it assures that substantially all of the individual fibers will have dye transferred thereto.

Dye station 40 is essentially the same as the first dye station with the exception that the rolls are in reverse order. That is to say, they are in position so as to apply dye to the opposite side of the sheet of tow designated as side E.

Particularly, dye station 40 is composed of print roll 42 having pressure adjusting means 44 attached thereto for adjusting roll 42 in either direction along the arrow designated as F.

Opposite print roll 42 is pad roll 46 which also has an absorbent coating thereon. Roll 46 is a driven roll. On the opposite side thereof is dye transfer roll 48 which is partially immersed in reservoir 50 and has pressure adjustment device 52 attached thereto in order to adjust dye transfer roll 48 in either direction along the arrow designated as G.

This dye station operates in essentially the same manner as the first dye station, the only difference being that due to the opposite juxtaposition of the rolls as compared to the first dye station, the predetermined design pattern corresponding to the pattern on print roll 42 will be transferred to side E of the sheet of tow 24 since it is this side which comes into contact with covered roll 46.

It is clear further from the utilization of these two dye stations, that one may use either the same design pattern on each of rolls 28 and 42 or may vary the design patterns depending on the specific results intended. For example, one may use a spiral design pattern similar to that on roll 32 with the exception that the spirals travel in the direction opposite to those of roll 28. Also, one may use a greater or lesser number of such spirals or vary the pitch of the spirals again depending on the specific end result desired.

Additionally, one may use a different color dye in the second dye station from that used in the first dye station. Whether or not this is done will depend on the final heather effect desired.

Figure 4:
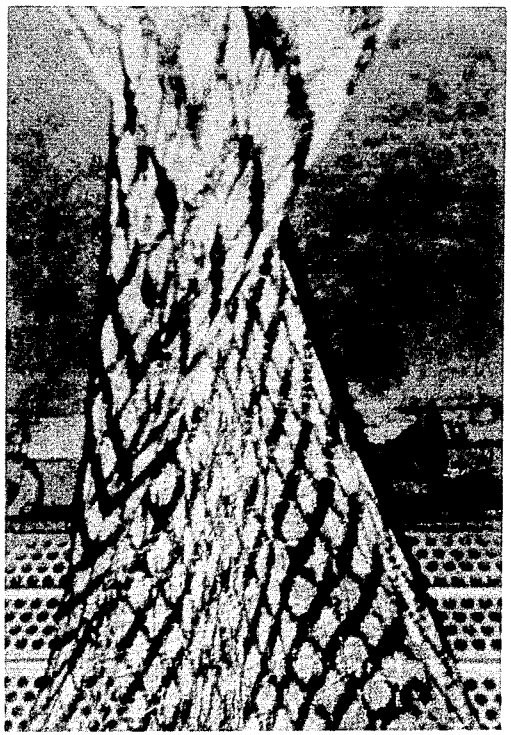
FIG. 4 is the opposite side of the sheet of FIG. 3 which is colored with the process of the present invention.

FIG. 4 is a photograph of tow sheet 24 showing side E after it has emerged from dye station 40. In this particular case, a print roll was utilized in dye station 40 which also had spiral ribs similar to those of print roll 28 at the first dye station although the width of the raised portions was less than that of those of roll 28 and the pitch was opposite so that a crisscross pattern between the imprint on side B and the imprint on side E was obtained. Again, of course, the rolls in print station 40 are adjusted appropriately so as to assure substantial penetration of the dyestuff transferred onto side E from pad roll 46.

After proceeding through dye station 40, the sheet of tow is transferred over rolls 54 and through collector 56, which is generally a funnel, to reform the sheet into a rope. The rope of reformed tow is designated as 58. It then traverses around change of direction rolls 60 and through placement rolls 62 which are merely opposing rolls having a slot therebetween which are attached to beam 64 which moves back and forth in the direction indicated by arrow H so as to direct the rope back and forth into container 66. This rope retrieval system is conventional in the art and is used merely for uniformly disposing the rope into container 66. It is noted that container 66 is on dolly system designated as 68 which, as roll 62 move back and forth in the direction of double arrow H, moves perpendicular to that direction so as to assure a uniform disposition of the rope, both widthwise and lengthwise, into the container.

Since generally the length of tow thus treated will be much greater than can fit on one container, as is conventional in treatment of textile fabrics in rope 4, when one container is full, additional containers are then placed onto the dolly to receive the further processed tow although the rope is never cut after the entire run is treated, the containers may be suitably transferred to the appropriate dye fixation, washing and drying equipment as is conventional in the art for the particular type of dyestuff and type of fabric being treated.

The amount of dye coverage of the tow, generally referred to as percentage of coverage (this percentage can be either lengthwise of the sheet or of the individual fibers, since the percentage would be equivalent in either case) is controlled by four factors:

(1) by the width and number of ribs on the print roll;
(2) by the pressure of the print roll against the second covered roll; and
(3) by the pressure of the dye transfer roll against the second covered roll; and
(4) by the concentration of the dyestuff paste.

It is, of course, not desired to completely cover all of portions of each of the fibers of the tow with the dye, but rather to obtain somewhat less than 100% coverage. Thus, these factors should be selected to achieve a coverage of from about 10 to 95% of the surface of the fibers in the tow. Preferably the amount of coverage is from 12 to 85%. However, it is clear that much of the adjustment depends on the actual end product which is desired and this would initially be set before starting the actual processing run by making small test samples and adjusting appropriately. Such adjustment would be within the skill of the artisan operating the process.

Figure 2:
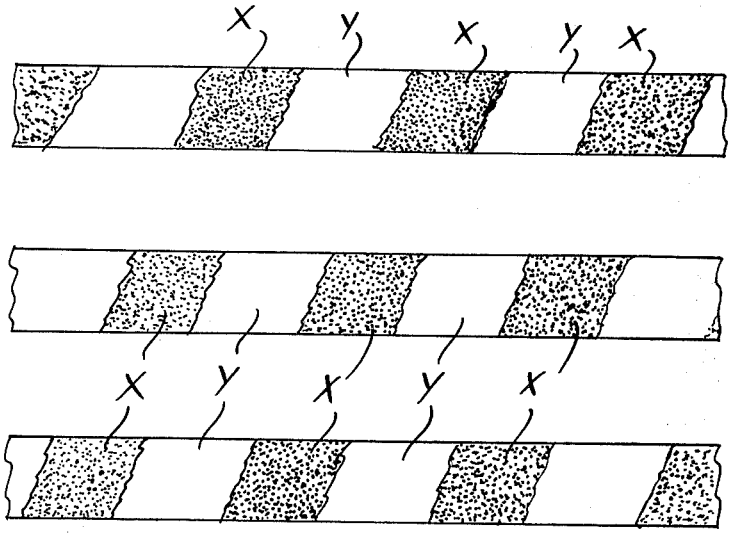
FIG. 2 is a drawing of a segment of a single continuous filament from tow colored by the process of the present invention.

Referring now to FIG. 2, a diagram representation of a series of fibers selected from tow colored by the present process are shown. The representation of the fibers is greatly magnified in order to show the intermittent spacing of the colored portions which are designated as X as distinguished from the uncolored portions designated as Y. When the individual fibers of the tow are actually viewed under magnification (about 5–10×), it is seen that the fibers along the length possess intermittent portions of colored areas and uncolored white areas which is the original color of the tow as it is received prior to treating with the present process. The length of the colored portions will vary somewhat since it will be appreciated that the sheet of tow which is being processed is quite uneven and the control over the intermittent spacing is not exact. Nevertheless, the colored areas will be intermittently broken by white areas and the amount of such intermittent spacing will further depend on the particular amount of coverage for which the process was initially set.

It is further noted that the colors of the various X portions may vary from one to another if, in the original process, the color of the dye in one dye station was different from that of another. The ultimate step in treating the dyed tow will be a blending operation and consequently the final color obtained will be an appropriate blend of the uncolored or white portion of the tow, and the various colored portions whether they be all the same color or different colors. The important aspect, however, of the tow product as it emerges from the present process is the fact that it remains in the form of continuous filaments as opposed to sliver formed from staple. It is because of this that the subsequent processing steps are simplified.

What is important, however, is the fact that since the individual pieces of staple formed from the dyed tow each possess splasches of color as opposed to being either completely colored or uncolored, the ultimate product possesses significantly greater homogeniety as compared with products produced by prior art processes.

As will be further seen, it is possible in the present process to include additional dye stations other than the two shown although from a commercial point of view it would generally appear to be less desirable since at come point combining so many colors or imprints would lead to disadvantages in the color desired by the ultimate blending. For most commercial purposes and colors of the heater product which would normally be desired, two dye stations would be sufficient.

It will also be further seen with respect to the points and rolls at which pressure may be applied at the dye stations that the pressure may be applied from other rolls, i.e., one may also utilize the dye transfer roll to apply additional pressure to the contact between the print roll and the pad roll and consequently a number of modifications of this type may be made. Also, of course, it is possible to make the print roll rather than the pad roll a driven roll although we have found it preferable to retain the pad roll as the driven roll in the system. Such variations are readily apparent to the skilled artisan.

Referring again to FIG. 1, the apparatus of the present invention comprises a means for spreading tow into a flattened sheet; a first means which constitutes the first dye station for applying and impregnating color to and into one side of the sheet in a predetermined design pattern; and a second means which constitutes the second dye station for applying and impregnating color to and into the other side of the sheet in a predetermined design pattern, which second means or second dye station is positioned subsequent to the first dye application means or dye station.

More particularly, both the first and second dye application stations comprise a print roll having raised portions on the surface thereof in the form of the desired design pattern; a second roll which is positioned opposite to the print roll and in rotatable contact therewith so as to create a space for feeding a flattened sheet of tow therebetween, the second roll having an absorbent outer covering thereon; means for driving at least one of the rolls and preferably the second roll and means for impregnating the covering with dye. The relationship of the print roll and second roll of the second dye station is opposite that of the corresponding rolls of the first application means for dye station.

The apparatus may further comprise means for adjusting the pressurized contact of the print roll against the second roll and the impregnation means may comprise a dye transfer roll which is partially immersed in a dye reservoir and which is in rotatable contact with the second roll. It is further possible and preferred that the dye transfer roll possess means for adjusting its pressure against the second or covered roll.

Additionally, it is noted that the present process and apparatus may be utilized to treat any type of synthetic continuous filament which can be embodied in tow form. Thus, typically, synthetic fibers such as nylon, polyester, acrylics, polyacetals, as well as many other known types of synthetic fibers can be treated. Understandably, the dye systems which would be utilized will depend on the particular type of synthetic fiber which is being treated as will the subsequent dye fixation, washing, drying, etc. steps.

What is claimed is:

1. A method for applying a color to continuous synthetic fibers in the form of tow comprising the steps of:

(a) spreading the tow into a flattened sheet;

(b) applying a coloring agent in a first predetermined design pattern to one side of the sheet so as to impregnate the color into the depth of the sheet and then (c) applying a coloring agent in a second predetermined design pattern to the other side of the sheet so as to impregnate the color into the depth of the sheet from said other side; said first and second design patterns being selected so as to produce intermittent colored and uncolored portions along the length of the fibers.

2. The method of claim 1 wherein the coloring agent applied is a textile dye and wherein after application of color to both sides of the sheet, the colored sheet is subject to dye fixation conditions.

3. The method of claim 2 wherein the dye application of step (b) is carried out by (d) dyeing a first side of the sheet by passing the sheet through a first dye station comprising a print roll having raised portions thereon in the pattern desired to be printed onto the sheet a second roll disposed opposite the print roll and in pressurized contact therewith for passing the sheet between and in contact with both the print and second rolls, said second roll having an absorbent outer covering for retaining dye;

and said covering being continuously impregnated with dye such that on passing the sheet through the space between the rolls, the raised portions of the print roll come into pressured contact with portions of the sheet and press said portions into the dye impregnated covering thereby transferring dye to that side of the sheet in contact with said covering in the predetermined design pattern and then (e) dyeing the other side of the sheet by passing the sheet through a second dye station comprising a print roll having raised portions thereon in the pattern desired to be printed onto the sheet; a second roll disposed opposite the print roll and in pressurized contact therewith for passing the sheet between and in contact with both the print and second rolls, said second roll having an absorbent outer covering for retaining dye;

and said covering being continuously impregnated with dye such that on passing the sheet through the space between the rolls, the raised portions of the print roll come into pressured contact with portions of the sheet and press said portions into the dye impregnated covering thereby transferring dye to that side of the sheet in contact with said covering in the predetermined design pattern said print and second roll in said second dye station being disposed relative to one another in a manner opposite to that of the rolls of the first dye station.

4. The method of claim 3 wherein the color applied at the first dye station is different from the color applied at the second dye station.

5. The method of claim 3 wherein the first design pattern is different from the second design pattern.

6. The method of claim 2 wherein the sheet is held in pressurized contact with the covered roll by applying pressure to the print roll.

7. The method of claim 2 wherein the means for impregnating the covered roll comprises a dye reservoir and a dye transfer roll, a portion of which passes through said dye reservoir and picks up dye, said transfer roll being in pressurized contact with said covered roll thereby transferring said dye to said covered roll.

8. The method of claim 6 wherein the pressure of the pick up roll against said covered roll is varied to vary the amount of dye transferred to said covered roll.

* * * * *